United States Patent [19]

Armour et al.

[11] 4,409,315

[45] Oct. 11, 1983

[54] REDUCING POST-PROCESS $D_{min}$ INCREASE IN POSITIVE REDOX DYE-RELEASING IMAGE TRANSFER SYSTEMS USING OXIDANTS IN COVER SHEETS

[75] Inventors: Eugene A. Armour; Richard P. Henzel; Rowland G. Mowrey, all of Rochester, N.Y.

[73] Assignee: Eastman Kodak Company, Rochester, N.Y.

[21] Appl. No.: 392,508

[22] Filed: Jun. 28, 1982

[51] Int. Cl.[3] ..... G03C 1/40; G03C 5/54

[52] U.S. Cl. ..... 430/214; 430/212; 430/236; 430/242; 430/223

[58] Field of Search ..... 430/212, 214, 223, 242, 430/236

[56] References Cited

U.S. PATENT DOCUMENTS

| | | | |
|---|---|---|---|
| 3,185,567 | 5/1965 | Rogers | 430/223 |
| 3,880,658 | 4/1975 | Lestina et al. | 430/226 |
| 4,088,488 | 5/1978 | Chang et al. | 430/223 |
| 4,139,379 | 2/1979 | Chasman et al. | 430/223 |
| 4,139,389 | 2/1979 | Hirshaw et al. | 430/223 |
| 4,232,107 | 11/1980 | Janssens | 430/223 |
| 4,256,826 | 3/1981 | Popp et al. | 430/223 |
| 4,353,975 | 10/1982 | Janssens et al. | 430/223 |

*Primary Examiner*—Richard L. Schilling
*Attorney, Agent, or Firm*—Harold E. Cole

[57] ABSTRACT

Photographic assemblages are described employing positive-working redox dye-releasers and a cover sheet containing an oxidant having an electrode potential of from about −200 mV up to about 1000 mV versus a saturated calomel electrode at a pH of about 5 to about 6. The oxidant is capable of oxidizing electron transfer agent in the system. The reduced form of the oxidant is incapable of reducing the positive-working redox dye-releaser. After processing, the oxidant reacts with the electron transfer agent to prevent it from reacting with the dye releaser which would otherwise cause further dye release. $D_{min}$ stability is thereby improved.

26 Claims, No Drawings

REDUCING POST-PROCESS $D_{min}$ INCREASE IN POSITIVE REDOX DYE-RELEASING IMAGE TRANSFER SYSTEMS USING OXIDANTS IN COVER SHEETS This invention relates to photography, and more particularly to photographic assemblages for color diffusion transfer photography employing at least one silver halide emulsion layer and a positive-working redox dye-releaser (PRDR) wherein a cover sheet is employed which contains a particular oxidant having a certain electrode potential. After processing, the oxidant oxidizes electron transfer agent present in the assemblage to prevent it from slowly reducing the PRDR which would cause unwanted dye release. Post-process $D_{min}$ stability is thereby achieved in accordance with this invention.

Various formats for color, integral transfer elements are described in the prior art, such as U.S. Pat. Nos. 3,415,644; 3,415,645; 3,415,646; 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layer begin to diffuse throughout the structure. At least a portion of the imagewise distribution of diffusible dyes diffuse to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 to 10 minutes or more in other formats. Since development occurs at a high pH, it is rapidly slowed by merely lowering the pH. The use of a neutralizing layer, such as a polymeric acid, can be employed for this purpose. Such a layer will stabilize the element after silver halide development and the required diffusion of dyes has taken place. A timing layer is usually employed in conjunction with the neutralizing layer, so that the pH is not prematurely lowered, which would prematurely restrict development and dye release. The development time is thus established by the time it takes the alkaline composition to penetrate through the timing layer. As the system starts to become stabilized, alkali is depleted throughout the structure, causing silver halide development to substantially cease in response to this drop in pH. This may also cause the dye release rate to slow down. For each image generating unit, this shutoff mechanism establishes the amount of silver halide development and the related amount of dye released or formed according to the respective exposure values.

In color transfer assemblages employing non-diffusible PRDR's, a dye is released as an inverse function of development, i.e., dye is released by some mechanism in the non-exposed areas of the silver halide emulsion. Use of a negative-working silver halide emulsion in such a system will therefore produce a positive image in the image-receiving layer. Examples of such PRDR's are described in U.S. Pat. Nos. 4,139,379 and 4,139,389. The immobile compounds described in these patents are ballasted electron-accepting nucleophilic displacement (BEND) compounds. The BEND compound as incorporated in a photographic element is incapable of releasing a diffusible dye. However, during photographic processing under alkaline conditions, the BEND compound is capable of accepting at least one electron (i.e. being reduced) from an incorporated reducing agent (IRA) and thereafter releases a diffusible dye. This occurs in the unexposed areas of the emulsion layer. In the exposed areas of the emulsion layer, however, an electron transfer agent (ETA) reduces the silver halide and becomes oxidized. The oxidized ETA is then reduced by the IRA, thus preventing the IRA from reacting with the BEND compound. The BEND compound therefore is not substantially reduced and thus no dye is released in the exposed areas.

After processing the photographic element described above, electron transfer agent remains after imaging in both the exposed and nonexposed areas. A problem which occurs is that the $D_{min}$ continues to increase over a period of time. This is sometimes described in the art as "post-process density increase". It is believed that over a period of time, the electron transfer agent can slowly reduce the PRDR and cause this unwanted dye release. We have found a way for lessening the extent of post process density increase in PRDR systems by providing a means to inactivate the electron transfer agent after imaging. The means which we have found is to incorporate a particular oxidant in a cover sheet as will be described more fully hereafter.

U.S. Pat. No. 4,139,379 of Chasman et al describes PRDR systems in which the present invention can be employed. In Example 2 of Chasman et al, an oxidant is employed in layer 4 of the photographic element as a scavenger. This prevents the incorporated reducing agent (or electron donor) associated with one of the emulsion layers from reacting in another emulsion layer and thereby reduces any color contamination or "cross-talk" between these layers. The oxidant used in our invention is employed in an entirely different location in the assemblage and for an entirely different purpose.

*Research Disclosure,* Vol. 192, April 1980, Item 19208, page 136 discloses that a peroxy compound may be employed in a cover sheet for use with color image transfer elements containing redox dye-releasers. The peroxy compound, however, is disclosed as being "catalytically decomposable". It functions both as an ETA and as a redox amplification oxidant to produce a color image in a low silver photographic element. In our invention, a separate ETA is employed and our oxidant is not a redox amplification oxidant, i.e., not "catalytically decomposable". The oxidant used in our invention is employed for an entirely different purpose and relates to a different problem than that of the *Research Disclosure* article.

U.S. Pat. Nos. 3,868,252, 3,928,043, 3,998,640 and 4,088,488 relate to the use of certain oxidants which can be used in various image transfer systems. The oxidants are disclosed as being used in either the processing composition or the image-receiving element. The oxidants are used, however, in systems containing as the dye image-providing material, oxichromic compounds which undergo chromogenic oxidation to form a new chromophore. These compounds are thus not PRDR's as described in this invention. The oxidants in these patents are used to form the final dye and thus do not relate to the problem which the present invention solves.

Other uses of oxidants in image transfer systems are described in U.S. Pat. Nos. 2,559,643 and 3,065,074 and U.K. Pat. No. 1,157,510. None of these patents, however, relates to PRDR systems as described herein, nor do they relate to the problem or purpose for use of the oxidants as described herein.

A photographic assemblage in accordance with our invention to be processed with an electron transfer agent comprises:

(a) a photographic element comprising a support having thereon at least one photosensitive silver halide emulsion layer having associated therewith a positive-working, redox dye-releaser;

(b) a dye image-receiving layer;

(c) a transparent cover sheet located over the layer outermost from the support;

and wherein the cover sheet contains an oxidant having an electrode potential of from about −200 mV up to about +1000 mV versus a saturated calomel electrode at a pH of about 5 to about 6, the oxidant being capable of oxidizing the electron transfer agent, and the reduced form of the oxidant being incapable of reducing the positive-working redox dye-releaser.

The oxidants which can be employed in our invention must have an electrode potential within a defined range at a given pH, as described above. Oxidants which are too weak would be marginally or totally ineffective. Strong oxidants, even though they may reduce $D_{min}$ increases, may attack the dye and cause a loss of densitay in $D_{max}$ areas. Some of the oxidants employed in our invention are water soluble and may be expected to diffuse from the cover sheet for reaction with the electron transfer agent. Other oxidants employed in our invention may have a very limited water solubility. It is believed that they would function by diffusion of the electron transfer agent to the cover sheet. In any event, locating the oxidant in the cover sheet enables it to function after imaging has been substantially completed. Otherwise, the oxidant might prematurely react with the ETA, or IRA if one is present, and prevent optimum image discrimination from taking place.

Any oxidant may be employed in our invention as long as it has the electrode potential as described above. In a preferred embodiment of our invention, the oxidant can be an inorganic salt, a quinone compound, a nitroxyl compound, a peroxy acid compound or a positive halogen compound. These compounds are usually nearly colorless. They may also be blocked, if desired to make them colorless or to prevent premature reaction. Inorganic salts useful in our invention include sodium nitrate, sodium iodate, sodium periodate, sodium chlorate, sodium bromate and sodium persulfate. Quinone compounds useful in our invention include phenyltrichloroquinone and pentadecyltrichloroquinone. Nitroxyl compounds useful in our invention include 4-hydroxy-2,2,6,6-tetramethylpiperidino-1-oxy, 3-carboxy-2,2,5,5-tetramethyl-3-pyrrolinyl-1-oxy, 3-succinimidocarbonyl-2,2,5,5-tetramethyl-3-pyrrolinyl-1-oxy, 3-carbamoyl-2,2,5,5-tetramethylpyrrolidinyl-1-oxy, 3-amino-2,2,5,5-tetramethyl piperidino-1-oxy, and polymeric nitroxyl compounds as disclosed in U.S. Pat. Nos. 3,868,252 and 4,088,488, the disclosures of which are hereby incorporated by reference. Peroxy acid compounds useful in our invention include, for example, perbenzoic acid and m-chloroperbenzoic acid. Positive halogen compounds are known in the art as compounds which are organic halogenating agents or oxidants and are described by R. Filler in *Chem. Revs.*, 63, 22 (1963). Such compounds include, for example, N-bromosuccinimide, Chloroamine-T ® (sodium p-toluenesulfonchloramide), N-chlorosuccinimide and N-bromoacetamide. Especially good results are obtained in a preferred embodiment of our invention with sodium iodate or pentadecyltrichloroquinone.

The oxidants employed in our invention may be present in any concentration which is effective for the intended purpose. In general, good results have been obtained at concentrations ranging from about 0.1 to about 10 grams per square meter of element, preferably 1 to 5 grams per square meter.

As previously described, the oxidant employed in our invention is located in the cover sheet. It may be located either in the timing layer or the neutralizing layer or adjacent layers. In a preferred embodiment of our invention, it is located either in the neutralizing layer or a separate layer adjacent thereto such as an interlayer or an overcoat layer.

Any PRDR's known in the art may be employed in our invention. Such PRDR's are disclosed, for example, in U.S. Pat. Nos. 4,139,379, 4,199,354, 4,232,107, 4,242,435, 4,273,855, 3,980,479 and 4,139,389, the disclosures of which are hereby incorporated by reference. In a preferred embodiment of our invention, the PRDR is a quinone PRDR and the photographic element contains an incorporated reducing agent as described in U.S. Pat. No. 4,139,379, referred to above. In another preferred embodiment, the quinone PRDR's have the formula:

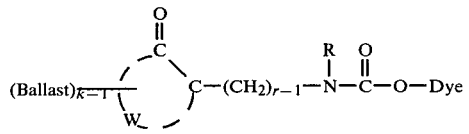

wherein:

Ballast is an organic ballasting radical of such molecular size and configuration as to render the compound nondiffusible in the photographic element during development in an alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

In a preferred embodiment of our invention, the silver halide emulsions employed are the conventional, negative-working emulsion well known to those skilled in the art. A positive image will thereby be obtained in the image-receiving layer. Use of a direct-positive emulsion will produce a negative image in the image-receiving layer. Such a negative can be used to produce positive prints if so desired.

The photographic element in the above-described photographic assemblage can be treated in any manner with an alkaline processing composition to effect or initiate development. One method for applying processing composition is by interjecting processing solution with communicating members similar to hypodermic syringes which are attached either to a camera or camera cartridge. The processing composition can also be applied by means of a swab or by dipping in a bath, if so desired. Another method of applying processing compositions to a film assemblage which can be used in our invention is the liquid spreading means described in U.S. application Ser. No. 282,616 of Columbus, filed July 13, 1981.

In another embodiment of the invention, the assemblage itself contains the alkaline processing composition and means containing same for discharge within the film unit, such as a rupturable container which is adapted to be positioned during processing of the film unit so that a compressive force applied to the container by pressure-applying members, such as would be found in a camera designed for in-camera processing, will effect a discharge of the container's contents within the film unit.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. In accordance with this embodiment of our invention, the dye image-receiving element would comprise a support having thereon, in sequence, a neutralizing layer, a timing layer and a dye image-receiving layer. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the above-described film asemblage is located integral with the photographic element and is located between the support and the lowermost photosensitive silver halide emulsion layer. One useful format for integral imaging receiver photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral imaging receiver photographic elements in which the present invention is employed is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition including an ETA and an opacifier, is positioned between the top layer and a transparent cover sheet which has thereon, in sequence, a neutralizing layer and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photographic element would comprise a support having thereon, in sequence, a neutralizing layer, a timing layer and at least one photosensitive silver halide emulsion layer having associated therewith a dye image-providing material. A dye image-receiving layer would be provided on a second support with the processing composition being applied therebetween. This format could either be peel-apart or integral, as described above.

A process for producing a photographic transfer image in color according to our invention from an imagewise exposed photosensitive element comprising a support having thereon at least one photosensitive silver halide emulsion layer having associated therewith a dye image-providing material as described above comprises treating the element with an alkaline processing composition in the presence of a silver halide developing agent or ETA to effect development of each of the exposed silver halide emulsion layers. An imagewise distribution of dye image-providing material is thus formed as a function of development, and at least a portion of it diffuses to a dye image-receiving layer to provide the transfer image. The electron transfer agent remaining in the photosensitive element after development is then oxidized by means of an oxidant, as described above, to prevent it from further reaction with the PRDR which would otherwise cause additional dye release over a period of time.

The film unit or assemblage of the present invention is used to produce images in single or multicolors. In a three-color system, each silver halide emulsion layer of the film assembly will have associated therewith a dye-releasing compound which releases a dye possessing a predominant spectral absorption within the region of the visible spectrum to which said silver halide emulsion is sensitive, i.e., the blue-sensitive silver halide emulsion layer will have a yellow dye-releaser associated therewith, the green-sensitive silver halide emulsion layer will have a magenta dye-releaser associated therewith and the red-sensitive silver halide emulsion layer will have a cyan dye-releaser associated therewith. The dye-releaser associated with each silver halide emulsion layer is contained either in the silver halide emulsion layer itself or in a layer contiguous to the silver halide emulsion layer, i.e., the dye-releaser can be coated in a separate layer underneath the silver halide emulsion layer with respect to the exposure direction.

The concentration of the dye-releasing compounds that are employed in the present invention can be varied over a wide range, depending upon the particular compound employed and the results desired. For example, a dye-releaser coated in a layer at a concentration of 0.1 to 3 g/m$^2$ has been found to be useful. The dye-releaser can be dispersed in a hydrophilic film-forming natural material or synthetic polymer, such as gelatin, polyvinyl alcohol, etc., which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; phenylenediamine compounds, such as or N,N,N',N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film unit to be activated by the alkaline processing composition, such as in the silver halide emulsion layers, the dye image-providing material layers, interlayers, image-receiving layer, etc.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid-and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed together with the dye releaser in gelatin or another aqueous alkaline solution-permeable polymeric binder and are about 0.6 to 7 microns in thickness; and the alkaline solution-permeable polymeric interlayers, e.g., gelatin, are about 0.2 to 5 microns in thickness. Of course, these thicknesses are approximate only and can be modified according to the product desired. The silver halide emulsions and dye releasers may also be coated in separate layers, if desired.

Scavengers for oxidized developing agents can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November, 1976 edition of *Research Disclosure,* the disclosure of which is hereby incorporated by reference.

Use of a neutralizing material in the film assemblages of this invention will usually increase the stability of the transferred image. Generally, the neutralizing material will effect a reduction in the pH of the image layer from about 13 or 14 to at least 11 and preferably 5 to 8 within a short time after treatment with alkali. Suitable materials and their functioning are disclosed on pages 22 and 23 of the July 1974 edition of *Research Disclosure,* and pages 35 through 37 of the July 1975 edition of *Research*

*Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of three primary regions of the spectrum can be disposed as a single segmented layer, e.g., as by the use of microvessels as described in Whitmore U.S. patent application Ser. No. 184,714, filed Sept. 8, 1980.

The silver halide emulsions useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Multicolor Photographic Test (A) A control cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$); and (2) a timing layer comprising 10.5 g/$m^2$ of cellulose acetate (40% acetyl) and 0.32 g/$m^2$ of poly(styrene-co-maleic anhydride) (50:50 weight ratio).

(B) Cover sheets according to the invention, B, C and D, were prepared similar to (A), except that sodium iodate was added as an overcoat between layers (1) and (2) at 2.2, 1.1 and 0.54 g/$m^2$. The overcoat was prepared by dissolving the sodium iodate in an acetone/water mixture.

An integral imaging-receiver (IIR) element was prepared by coating the following layers in the order recited on a transparent poly(ethylene terephthalate) film support. Quantities are parenthetically given in grams per square meter, unless otherwise stated.

(1) metal containing layer of nickel sulfate .$6H_2O$ (0.58) and gelatin (1.1);

(2) image-receiving layer of poly(4-vinylpyridine) (2.2) and gelatin (2.2);

(3) reflecting layer of titanium dioxide (17.3) and gelatin (2.6);

(4) opaque layer of carbon black (1.9) and gelatin (1.3);

(5) interlayer of gelatin (1.2);

(6) red-sensitive, negative-working silver bromoiodide emulsion (1.4 silver), gelatin (1.8), cyan PRDR (0.55), incorporated reducing agent IRA (0.29), and inhibitor (0.02);

(7) interlayer of gelatin (1.2) and scavenger (0.43);

(8) green-sensitive, negative-working, silver bromoiodide emulsion (1.4 silver), gelatin (1.6), magenta PRDR (0.58), incorporated reducing agent IRA (0.29), and inhibitor (0.007);

(9) interlayer of gelatin (1.1) and scavenger (0.43);

(10) blue-sensitive, negative-working silver bromoiodide emulsion (1.4 silver), gelatin (2.3), yellow PRDR (0.46), incorporated reducing agent IRA (0.45), and inhibitor (0.007); and

(11) overcoat layer of gelatin (0.98).

CYAN PRDR

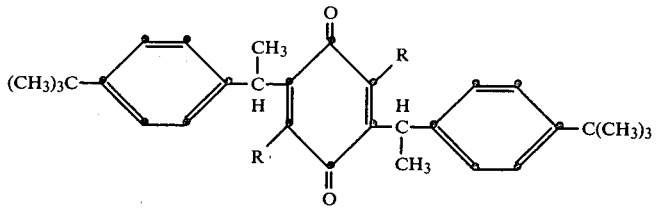

Where R =

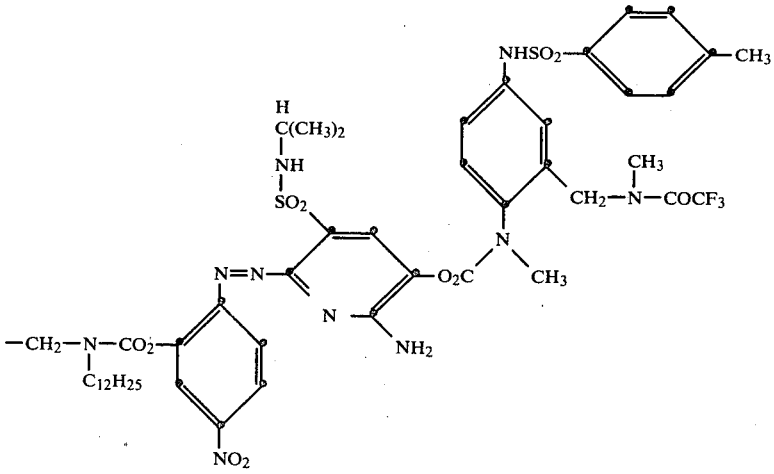

Dispersed in diethyllauramide (PRDR:solvent 2:1)

MAGENTA PRDR

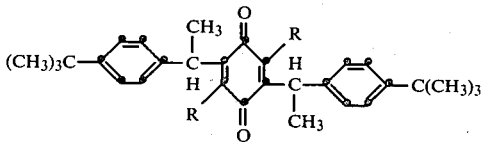

Where R =

-continued

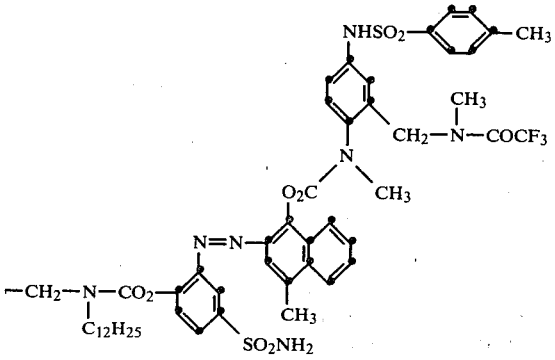

Dispersed in diethyllauramide (PRDR:solvent 1:1)

YELLOW PRDR

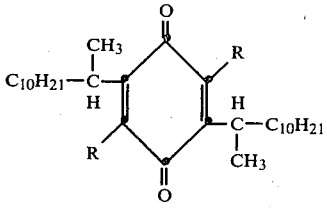

Where R =

-continued

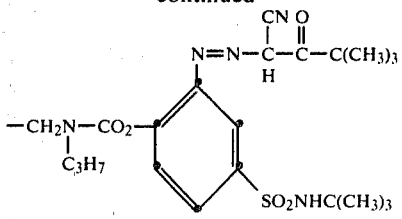

Dispersed in diethyllauramide (PRDR:solvent 2:1)

IRA

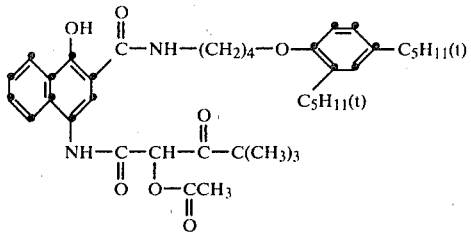

Dispersed in diethyllauramide (Total solid:solvent 2:1)

INHIBITOR

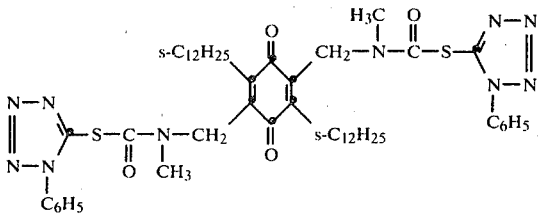

Dispersed in diethyllauramide (Total solid:solvent 2:1)

SCAVENGER

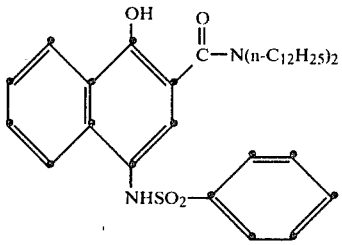

Samples of the imaging-receiver element were exposed in a sensitometer through a graduated density test object to yield a neutral at a Status A midscale density of approximately 1.0. The exposed samples were then processed by rupturing a pod containing the viscous processing composition described below between the imaging-receiver element and the cover sheets described above, by using a pair of juxtaposed rollers to provide a processing gap of about 100 μm.

The processing composition was as follows:

| | |
|---|---|
| 51 g | potassium hydroxide |
| 3.4 g | sodium hydroxide |
| 8 g | 4-hydroxymethyl-4-methyl-1-phenyl-3-pyrazolidinone |
| 10 g | ethylenediaminetetraacetic acid, disodium salt dihydrate |
| 0.4 g | lead oxide |
| 2 g | sodium sulfite |
| 2 g | Tamol SN ® dispersant |
| 5 g | potassium bromide |
| 56 g | carboxymethylcellulose |
| 165 g | carbon |
| | water to 1 liter |

Within several hours, the red, green and blue Status A density of the receiver side of the IIR was read. After a period of 48 hours incubation at 60° C./70% RH, the densities of the same $D_{max}$ and $D_{min}$ areas were read again. The following results were obtained:

TABLE 1

| Cover Sheet | Oxidant | | Density $D_{max}/D_{min}$ Fresh | Incubated 60°/70% RH | $\Delta D_{min}$ |
|---|---|---|---|---|---|
| A | None | R | 1.9/0.16 | 2.0/0.85 | +0.69 |
| | (Control) | G | 1.7/0.14 | 1.9/0.92 | +0.78 |
| | | B | 2.0/0.19 | 2.1/1.05 | +0.86 |
| B | Sodium | R | 1.9/0.16 | 1.9/0.23 | +0.07 |
| | iodate | G | 1.7/0.14 | 1.7/0.21 | +0.07 |
| | (2.2 g/m²) | B | 2.0/0.19 | 2.0/0.34 | +0.15 |
| C | Sodium | R | 1.9/0.16 | 2.0/0.27 | +0.11 |
| | iodate | G | 1.7/0.14 | 1.7/0.22 | +0.08 |
| | (1.1 g/m²) | B | 2.0/0.16 | 2.0/0.33 | +0.17 |
| D | Sodium | R | 1.9/0.16 | 2.1/0.55 | +0.39 |
| | iodate | G | 1.7/0.15 | 1.8/0.34 | +0.19 |
| | (0.54 g/m²) | B | 2.1/0.19 | 2.1/0.44 | +0.25 |

The above results indicate that the "fresh" sensitometry of the control and the IIR's of the invention are essentially equivalent. Upon incubation, however, the use of sodium iodate in the cover sheet according to the invention greatly improves the $D_{min}$ stability (the $\Delta D_{min}$ is less than the control) with little change in $D_{max}$.

EXAMPLE 2

Multicolor Photographic Test (A) A control cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 75 meq. acid/m²); and (2) a timing layer comprising a 1:1 physical mixture of the following two polymers coated at 2.2 g/m²:

(a) poly(acrylonitrile-co-vinylidene chloride-co-acrylic acid) (wt. ratio 14:79:7), and (b) a lactone polymer, partially hydrolyzed and 1-butanol transesterified poly(vinyl acetate-co-maleic anhydride) (ratio of acid/butyl ester 15:85).

(B) A cover sheet according to the invention was prepared similar to (A) except that the oxidant pentadecyltrichloroquinone (4.3 g/m²) was added to the timing layer melt as a 10% solution in tetrahydrofuran. The timing layer was also coated at 4.3 g/m².

An IIR was prepared similar to that of Example 1 except that in layer 8, the magenta PRDR was employed at 0.53 g/m² and in layer 6, the cyan PRDR was the same as that of Example 1 except that the group in the 3-position of the pyridyl ring was $—SO_2NHC_6H_5$ (instead of $—SO_2NHCH—(CH_3)_2$). The processing composition was the same as in Example 1.

Processing was conducted as in Example 1 with the following results:

TABLE 2

| Cover Sheet | Oxidant | | Density $D_{max}/D_{min}$ Fresh | Incubated 60°/70% RH | $\Delta D_{min}$ |
|---|---|---|---|---|---|
| A | None | R | 1.7/0.20 | 2.2/1.06 | +0.86 |
| | (Control) | G | 1.5/0.17 | 1.8/0.60 | +0.43 |
| | | B | 1.9/0.19 | 2.1/0.78 | +0.59 |
| B | Pentadecyl- | R | 1.8/0.20 | 2.2/0.58 | +0.38 |
| | Trichloro- | G | 1.8/0.17 | 2.0/0.34 | +0.17 |
| | quinone | B | 2.0/0.20 | 2.1/0.39 | +0.19 |

The above results indicate that upon incubation, the use of pentadecyltrichloroquinone in the cover sheet according to the invention greatly improves the $D_{min}$ stability (the $\Delta D_{min}$ is less than the control) with little change in $D_{max}$.

EXAMPLE 2

Monochrome Photographic Test (A) A control cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$); and (2) a timing layer comprising a 1:1 physical mixture of the following two polymers coated at 4.8 g/$m^2$:

(a) poly(acrylonitrile-co-vinylidene chloride-co-acrylic acid) (wt. ratio 14:79:7), and (b) a lactone polymer, partially hydrolyzed and 1-butanol transesterified poly(vinyl acetate-co-maleic anhydride) (ratio of acid/butyl ester 15:85).

(B) Experimental cover sheets were prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$); and (2) an overcoat layer containing various oxidants as listed in Table 3.

The overcoat layer was hand-coated with a narrow width coating blade on top of ½ the width of the acid layer. The overcoat layer coating was prepared by dissolving 500 mg of the oxidant in 10 ml acetone/water. A drop or two of an anionic surfactant was added for ease of coating. The ratio of acetone/-water was varied as necessary depending upon the solubility of the particular oxidant. In this manner, a coating was obtained with an area of no oxidant (control) on ½ the coating width and oxidant at an estimated coverage of 5 g/$m^2$ on the other half of the cover sheet.

An integral imaging-receiver (IIR) element was prepared by coating the following layers in the order recited on a transparent poly(ethylene terephthalate) film support. Quantities are parenthetically given in grams per square meter, unless otherwise stated.

(1) metal containing layer of nickel sulfate .$6H_2O$ (0.58) and gelatin (1.1);

(2) image-receiving layer of poly(4-vinylpyridine) (2.2) and gelatin (2.2);

(3) reflecting layer of titanium dioxide (17) and gelatin (2.6);

(4) opaque layer of carbon black (1.9) and gelatin (1.3);

(5) interlayer of gelatin (1.2);

(6) blue-sensitive, negative-working silver bromoiodide emulsion (1.6 silver), gelatin (2.2), yellow PRDR-B (0.43), incorporated reducing agent IRA (0.39), and inhibitor (0.007); and (7) overcoat of gelatin (1.0)

YELLOW PRDR-B

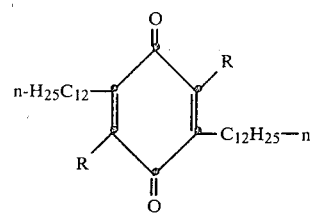

Where R =

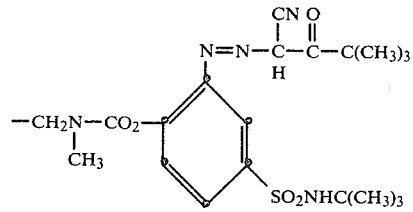

Dispersed in 1,4-cyclohexylene dimethylene bis-(2-ethyl hexanoate) (PRDR:solvent 2:1)

Samples of the imaging-receiver element were exposed in a sensitometer through a graduated density test object to yield a full scale image. The exposed samples were then processed by rupturing a pod containing the viscous processing composition described below between the imaging-receiver element and the control cover sheet A described above, by using a pair of juxtaposed rollers to provide a processing gap of about 100 μm.

The processing composition was as follows:

| | |
|---|---|
| 51 g | potassium hydroxide |
| 3.4 g | sodium hydroxide |
| 12 g | 4-hydroxymethyl-4-methyl-1-phenyl-3-pyrazolidinone |
| 0.4 g | lead oxide |
| 2 g | sodium sulfite |
| 2 g | Tamol SN ® dispersant |
| 5 g | potassium bromide |
| 56 g | carboxymethylcellulose |
| 165 g | carbon |
| | water to 1 liter |

After 20 minutes, the control cover sheet A was peeled off the IIR and the IIR was relaminated with a neutral pH pod to the experimental cover sheets described in B) above. Within several hours, the Status A blue density of both sections of the receiver side were read to provide fresh $D_{min}$ data. After 1 week keeping at room temperature, the same areas were read again. The $D_{min}$ differences are a measure of the $D_{min}$ stability. The side of the coating with no oxidant serves as an internal control. The following results were obtained:

TABLE 3

| Oxidant in ½ of Cover Sheet | (No Oxidant Side/Oxidant Side) $D_{min}$ (fresh) | $D_{min}$ (after 1 week) | $\Delta D_{min}$ |
|---|---|---|---|
| Sodium nitrate | 0.20/0.19 | 0.26/0.23 | +0.06/+0.04 |
| Sodium iodate | 0.19/0.22 | 0.21/0.21 | +0.02/−0.01 |
| Sodium periodate | 0.19/0.22 | 0.25/0.22 | +0.06/0 |
| Sodium chlorate | 0.20/0.19 | 0.26/0.24 | +0.06/+0.05 |
| Sodium bromate | 0.19/0.19 | 0.26/0.27 | +0.07/+0.08 |
| Phenyltrichloro-quinone | 0.19/0.19 | 0.27/0.25 | +0.08/+0.06 |
| Pentadecyltrichloro-quinone | 0.19/0.19 | 0.27/0.28 | +0.08/+0.09 |
| 4-Hydroxy-2,2,6,6-tetramethylpiperi-dino-1-oxy | 0.20/0.21 | 0.28/0.20 | +0.08/−0.01 |
| 4-Amino-2,2,6,6-tetramethylpiperi-dino-1-oxy | 0.22/0.24 | 0.32/0.31 | +0.10/−0.07 |
| 3-Carboxy-2,2,5,5-tetramethyl-3-pyrro-linyl-1-oxy | 0.22/0.22 | 0.30/0.22 | +0.08/0 |
| 3-Succinimidocarbonyl-2,2,5,5-tetramethyl-3-pyrrolinyl-1-oxy | 0.21/0.22 | 0.30/0.24 | +0.09/+0.02 |
| 3-Carbamoyl-2,2,5,5-tetramethylpyrroli-dinyl-1-oxy | 0.21/0.24 | 0.30/0.22 | +0.09/−0.02 |
| N—Bromosuccinimide | 0.18/0.24 | 0.27/0.26 | +0.09/+0.02 |
| Chloramine-T | 0.18/0.19 | 0.27/0.23 | +0.09/+0.04 |
| m-Chloroperbenzoic acid | 0.18/0.18 | 0.27/0.24 | +0.09/+0.06 |

The above results generally show an improvement in $D_{min}$ stability for the oxidant side of the cover sheet. No attempt was made at optimization of the concentration. Greater differences would also be expected after longer periods of time and/or at elevated temperatures.

The invention has been described in detail with particular reference to preferred embodiments thereof, but it will be understood that variations and modifications can be effected within the spirit and scope of the invention.

What is claimed is:

1. In a photographic assemblage to be processed with an electron transfer agent, said assemblage comprising:

(a) a photographic element comprising a support having thereon a dye image-receiving layer and at least one photosensitive silver halide emulsion layer having associated therewith a nondiffusible, positive-working, redox dye-releaser capable of releasing a diffusible dye upon reduction; and (b) a transparent cover sheet located over the layer outermost from said support;

the improvement wherein said cover sheet contains an oxidant having an electrode potential of from about −200 mV up to about +1000 mV versus a saturated calomel electrode at a pH of about 5 to about 6, said oxidant being capable of oxidizing said electron transfer agent, and the reduced form of said oxidant being incapable of reducing said positive-working redox dye-releaser.

2. The assemblage of claim 1 wherein said oxidant is present at a concentration of from about 0.1 to about 10 g/m$^2$.

3. The assemblage of claim 1 wherein said cover sheet is coated with, in sequence, a neutralizing layer and a timing layer.

4. The assemblage of claim 3 wherein said oxidant is located in said neutralizing layer or a layer adjacent thereto.

5. The assemblage of claim 1 wherein said oxidant is an inorganic salt, a quinone compound, a nitroxyl compound, a peroxy acid compound or a positive halogen compound.

6. The assemblage of claim 5 wherein said oxidant is sodium iodate or pentadecyltrichloroquinone.

7. In a photographic assemblage comprising:

(a) a photographic element comprising a support having thereon a dye image-receiving layer and at least one photosensitive silver halide emulsion layer having associated therewith a nondiffusible, positive-working, redox dye-releaser capable of releasing a diffusible dye upon reduction;

(b) an alkaline processing composition and means for discharging same within said assemblage; and (c) a transparent cover sheet located over the layer outermost from said support;

said photographic element or said processing composition containing an electron transfer agent;

the improvement wherein said cover sheet contains an oxidant having an electrode potential of from about −200 mV up to about +1000 mV versus a saturated calomel electrode at a pH of about 5 to about 6, said oxidant being capable of oxidizing said electron transfer agent, and the reduced form of said oxidant being incapable of reducing said positive-working redox dye-releaser.

8. The assemblage of claim 7 wherein said positive-working redox dye-releaser is a quinone redox dye-releaser and said photographic element contains an incorporated reducing agent.

9. The assemblage of claim 8 wherein said quinone redox dye-releaser has the formula:

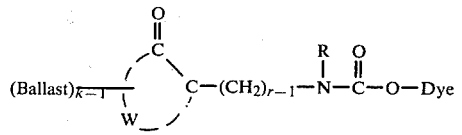

wherein:

Ballast is an organic ballasting radical of such molecular size and configuration as to render said compound nondiffusible in said photographic element during development in an alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

10. The assemblage of claim 7 wherein said oxidant is present at a concentration of from about 0.1 to about 10 g/m$^2$.

11. The assemblage of claim 7 wherein said cover sheet is coated with, in sequence, a neutralizing layer and a timing layer.

12. The assemblage of claim 11 wherein said oxidant is located in said neutralizing layer or a layer adjacent thereto.

13. The assemblage of claim 7 wherein said oxidant is an inorganic salt, a quinone compound, a nitroxyl compound, a peroxy acid compound or a positive halogen compound.

14. The assemblage of claim 13 wherein said oxidant is sodium iodate or pentadecyltrichloroquinone.

15. The assemblage of claim 7 wherein said discharging means is a rupturable container containing said alkaline processing composition and an opacifying agent, said container being so positioned during processing of said assemblage that a compressive force applied to said container will effect a discharge of the container's contents between said cover sheet and the layer outermost from said support.

16. The assemblage of claim 7 wherein said photographic element comprises a support having thereon said dye image-receiving layer, a red-sensitive, negative-working, silver halide emulsion layer having a nondiffusible, positive-working, redox cyan dye-releaser associated therewith capable of releasing a diffusible cyan dye upon reduction; a green-sensitive, negative-working, silver halide emulsion layer having a nondiffusible, positive-working, redox magenta dye-releaser associated therewith capable of releasing a diffusible magenta dye upon reduction; and a blue-sensitive, negative-working, silver halide emulsion layer having a nondiffusible, positive-working, redox yellow dye-releaser associated therewith capable of releasing a diffusible yellow dye upon reduction.

17. In an integral photographic assemblage comprising:

(a) a photographic element comprising a transparent support having thereon the following layers in sequence: a dye image-receiving layer; an alkaline solution-permeable, light-reflective layer; an alkaline solution-permeable, opaque layer; a red-sensitive, negative-working, silver halide emulsion layer having a nondiffusible, positive-working, redox cyan dye-releaser associated therewith capable of releasing a diffusible cyan dye upon reduction; a green-sensitive, negative-working, silver halide emulsion layer having a nondiffusible, positive-working, redox magenta dye-releaser associated therewith capable of releasing a diffusible magenta dye upon reduction; and a blue-sensitive, negative-working, silver halide emulsion layer having a nondiffusible, positive-working, redox yellow dye-releaser associated therewith capable of releasing a diffusible yellow dye upon reduction;

(b) a transparent cover sheet superposed over said blue-sensitive silver halide emulsion layer and comprising a transparent support coated with, in sequence, a neutralizing layer and a timing layer; and (c) a rupturable container containing an alkaline processing composition including an electron transfer agent and an opacifying agent, said container being so positioned during processing of said assemblage that a compressive force applied to said container will effect a discharge of the container's contents between said transparent sheet and said blue-sensitive silver halide emulsion layer;

the improvement wherein said cover sheet contains an oxidant having an electrode potential of from about −200 mV up to about +1000 mV versus a saturated calomel electrode at a pH of about 5 to about 6, said oxidant being capable of oxidizing said electron transfer agent, and the reduced form of said oxidant being incapable of reducing said positive-working redox dye-releasers.

18. The assemblage of claim 17 wherein each said positive-working redox dye-releaser is a quinone redox dye-releaser and said photographic element contains an incorporated reducing agent.

19. The assemblage of claim 18 wherein said quinone redox dye-releaser has the formula:

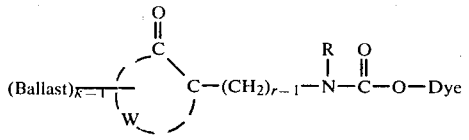

wherein:

Ballast is an organic ballasting radical of such molecular size and configuration as to render said compound nondiffusible in said photographic element during development in said alkaline processing composition;

W represents at least the atoms necessary to complete a quinone nucleus;

r is a positive integer of 1 or 2;

R is an alkyl radical having 1 to about 40 carbon atoms or an aryl radical having 6 to about 40 carbon atoms;

k is a positive integer of 1 to 2 and is 2 when R is a radical of less than 8 carbon atoms; and Dye is an organic dye or dye precursor moiety.

20. The assemblage of claim 17 wherein said oxidant is present at a concentration of from about 0.1 to about 10 g/m$^2$.

21. The assemblage of claim 17 wherein said oxidant is located in said neutralizing layer or a layer adjacent thereto.

22. The assemblage of claim 17 wherein said oxidant is an inorganic salt, a quinone compound, a nitroxyl compound, a peroxy acid compound or a positive halogen compound.

23. The assemblage of claim 22 wherein said oxidant is sodium iodate or pentadecyltrichloroquinone.

24. In a process for producing a photographic transfer image in color from an imagewise-exposed photosensitive element comprising a support having thereon a dye image-receiving layer, at least one photosensitive silver halide emulsion layer having associated therewith a dye image-providing material comprising a nondiffusible, positive-working, redox dye-releaser capable of releasing a diffusible dye upon reduction, said process comprising treating said element with an alkaline processing composition in the presence of an electron transfer agent to effect development of each of said exposed silver halide emulsion layers, whereby an imagewise distribution of dye image-providing material is formed as a function of development and at least a portion of its diffuses to said dye image-receiving layer to provide said transfer image, the improvement comprising oxidizing said electron transfer agent remaining in said photosensitive element after development by means of an oxidant contained in a cover sheet to prevent said electron transfer agent from further reaction with said positive-working redox dye-releaser which would otherwise cause additional dye release over a period of time, said oxidant having an electrode potential of from about −200 mV up to about +1000 mV versus a saturated calomel electrode at a pH of about 5 to about 6, said oxidant being capable of oxidizing said electron transfer agent, and the reduced form of said oxidant being incapable of reducing said positive-working redox dye-releaser.

25. The process of claim 24 wherein said oxidant is an inorganic salt, a quinone compound, a nitroxyl compound, a peroxy acid compound or a positive halogen compound.

26. The process of claim 24 wherein said oxidant is sodium iodate or pentadecyltrichloroquinone.

* * * * *